US012295474B2

(12) United States Patent
Glazenburg et al.

(10) Patent No.: US 12,295,474 B2
(45) Date of Patent: May 13, 2025

(54) EPILATING DEVICE

(71) Applicant: KONINKLIJKE PHILIPS N.V., Eindhoven (NL)

(72) Inventors: Joost Tomas Glazenburg, Groningen (NL); Johannes Beugels, Peize (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 583 days.

(21) Appl. No.: 17/626,525

(22) PCT Filed: Jul. 13, 2020

(86) PCT No.: PCT/EP2020/069682
§ 371 (c)(1),
(2) Date: Jan. 12, 2022

(87) PCT Pub. No.: WO2021/009089
PCT Pub. Date: Jan. 21, 2021

(65) Prior Publication Data

US 2022/0232943 A1 Jul. 28, 2022

(30) Foreign Application Priority Data

Jul. 16, 2019 (EP) ..... 19186466

(51) Int. Cl.
*A45D 26/00* (2006.01)

(52) U.S. Cl.
CPC ..... *A45D 26/0028* (2013.01)

(58) Field of Classification Search
CPC . A45D 26/00; A45D 26/0023; A45D 26/0028
See application file for complete search history.

(56) References Cited

U.S. PATENT DOCUMENTS 5,234,442 A 8/1993 Schafer
5,857,903 A 1/1999 Ramspeck
(Continued)

FOREIGN PATENT DOCUMENTS

EP 0328426 A2 8/1989
EP 0532106 A1 3/1993
WO 2010/063240 A1 6/2010

OTHER PUBLICATIONS

International Search Report and Written Opinion Dated Sep. 9, 2020 for International Application No. PCT/EP2020/069682 Filed Jul. 13, 2020.

*Primary Examiner* — Todd J Scherbel

(57) ABSTRACT

An epilating device for extracting hairs out of a user's skin, including an epilating system having a plurality of hair-clamping elements arranged adjacent to each other and rotatable relative to a housing about an axis of rotation, a compression member arranged to exert a compression force on the epilating system along at least a compression line which extends parallel to a main direction of extension of the axis of rotation, and a drive system arranged to rotate the hair-clamping elements about the axis of rotation. The hair-clamping elements are arranged to cooperate in pairs. During rotation of the epilating system, the paired hair-clamping elements are tiltable relative to each other, under influence of said compression force about at least one tilting axis from a hair-catching position and about only one tilting axis from a first hair-clamping position.

20 Claims, 5 Drawing Sheets

(56) References Cited

U.S. PATENT DOCUMENTS

| | | | | |
|---|---|---|---|---|
| 6,613,057 | B1 * | 9/2003 | Obermann | A45D 26/0028 606/133 |
| 2007/0093853 | A1 | 4/2007 | Poran | |
| 2008/0200929 | A1 * | 8/2008 | Obermann | A45D 26/0028 606/133 |
| 2009/0182349 | A1 | 7/2009 | Poran | |
| 2015/0245696 | A1 | 9/2015 | Hietbrink | |

* cited by examiner

EPILATING DEVICE

CROSS REFERENCE TO RELATED APPLICATIONS

This application is the U.S. National Phase application under 35 U.S.C. § 371 of International Application No. PCT/EP2020/069682 filed Jul. 13, 2020, which claims the benefit of European Patent Application Number 19186466.9 filed Jul. 16, 2019. These applications are hereby incorporated by reference herein.

FIELD OF THE INVENTION

The invention relates to an epilating device for extracting hairs out of the user's skin.

BACKGROUND OF THE INVENTION

From U.S. Pat. No. 6,613,057 A an epilating device for extracting hairs out of the user's skin, is known comprising: a housing; an epilating system comprising a plurality of hair-clamping elements arranged adjacent to each other and rotatable relative to the housing about an axis of a rotation; a compression member arranged to exert a compression force on the epilating system along at least a compression line which extends parallel to a main direction of extension of the axis of rotation; and a drive system arranged to rotate the hair-clamping elements about the axis of rotation; wherein the hair-clamping elements are arranged to cooperate in pairs, and wherein, during rotation of the epilating system, the hair-clamping elements of each pair of hair-clamping elements are tiltable relative to each other, under the influence of said compression force, about at least one tilting axis from a hair-catching position, wherein two adjacent hair-clamping areas of the pair of hair-clamping elements are at a distance from each other, into a hair-clamping position, wherein the two adjacent hair-clamping areas are in mutual clamping engagement, and vice versa.

The known epilating device comprises a housing with an opening, behind which a rotatable drive shaft is arranged extending parallel to the opening and carrying a series of cooperating pinching elements coupled to the drive shaft in the rotational direction. During rotation of the drive shaft, pairs of adjacent pinching elements are periodically pivoted with respect to each other, under the influence of a compression member, from a catching position, in which a distance is present between the pinching elements near the opening, into a pinching position, in which the pinching elements contact each other near the opening. At least one of the pinching elements of each pair comprises a delaying element for delaying or postponing a pivotal motion of the pinching elements towards the pinching position. The delaying element comprises at least a first and a second contact position for each pair of cooperating pinching elements, where the contact positions define a pivot axis about which the two pinching elements are pivotable with respect to each other. The pivot axis is arranged at a distance from a central point of the pinching elements and between the central point and a pinching surface of the pinching elements. In this manner, a relatively strong delaying effect of the delaying element shall be achieved which shall result in good synchronization of the pivotal movements of the pairs of pinching elements, which are in the pinching position at the same moment.

However, although the delaying element may help to improve the performance of the epilating device, still there is a need for a further improvement of an epilating device with respect to the hair-catching efficiency.

Another epilating device that is known from US 2009/0182349 A1 comprises a housing, wherein an epilator assembly is arranged that includes a series of disks having pincer elements on each side. The pincers are arranged tiltable between adjacent disks. Adjacent pincers cooperate for catching and pincing hair. The pincers are arranged tiltable between the disks about recesses, wherein they are held.

Further, by use in public another epilating device has become known which is sold by the applicant.

The known epilating device comprises a housing with an epilating system comprising a plurality of hair-clamping elements that are rotatably supported by a curved supporting shaft mounted in a stationary position relative to the housing, wherein the hair-clamping elements each comprise a receiving opening arranged centrally on the hair-clamping element for receiving the supporting shaft; wherein a compression member is arranged to exert a compression force on the epilating system and a drive system is arranged to rotate the hair-clamping elements about the axis of rotation. The hair-clamping elements are arranged to cooperate in pairs, and, during rotation of the epilating system, the hair-clamping elements of each pair of hair-clamping elements are tiltable relative to each other, under influence of the compression force, about two tilting axes between a neutral position, wherein the hair-clamping elements of each pair are parallel to each other, between a first tilted position, wherein the hair-clamping elements are tilted to one side for pinching hairs, and between a second tilting position, wherein the hair-clamping elements are tilted to the opposite side for pinching hairs.

Although this epilating device has a good hair-catching efficiency, still there is a need for improvement.

SUMMARY OF THE INVENTION

In view of this it is the object of the invention to disclose an epilating device that offers an improved efficiency with respect to catching and removing hairs.

This object is achieved with an epilating device as mentioned at the outset in that the hair-clamping elements of each pair of hair-clamping elements are tiltable relative to each other, under the influence of the compression force, about only one tilting axis from a first hair-clamping position, wherein two adjacent first hair-clamping areas of the pair of hair-clamping elements are in mutual clamping engagement, into a second hair-clamping position, wherein two adjacent second hair-clamping areas of the pair of hair-clamping elements are in mutual clamping engagement, wherein the only one tilting axis is arranged eccentrically relative to the axis of rotation, and wherein the second hair-clamping areas are arranged opposite to the first hair-clamping areas relative to the axis of rotation.

According to the invention each pair of adjacent hair-clamping elements can mutually tilt or pivot about only a single tilting axis which extends perpendicularly to the axis of rotation and is arranged in an off-center location at a distance from the axis of rotation. During rotation of the epilating system, each pair of adjacent hair-clamping elements pivots from the first hair-clamping position to the second hair-clamping position or vice versa when the respective single tilting axis passes the compression line. In the first hair-clamping position, the two adjacent first hair-clamping areas of the pair of hair-clamping elements are in mutual clamping engagement, while the two adjacent second hair-clamping areas of the pair of hair-clamping elements are in an open hair-catching position at a distance from one another. In the second hair-clamping position, the two adjacent second hair-clamping areas of the pair of hair-clamping elements are in mutual clamping engagement, while the two adjacent first hair-clamping areas of the pair of hair-clamping elements are in an open hair-catching position at a distance from one another. According to the invention, a hair-clamping area is to be understood as a portion of a hair-clamping element that will come into clamping engagement with a co-operating hair-clamping area of an adjacent hair-clamping element as a result of tilting of the pair of adjacent hair-clamping elements about the single tilting axis. The hair-clamping area is to be understood as extending in a radial direction relative to the axis of rotation until a circumferential edge of the hair-clamping element. I.e., in the hair-clamping position, the two adjacent hair-clamping areas are to be understood to be in mutual clamping engagement at least at the circumferential edge of the hair-clamping element, so that hairs as short as possible can be clamped between the two adjacent hair-clamping areas.

Because each pair of adjacent hair-clamping elements only has a single tilting axis, the closing speed (i.e. the speed at which the hair-clamping elements pivot from the opening to the closed position) is relatively high. As a result of the high closing speed, the hair-catching efficiency (i.e. the probability that a hair will be caught by the clamping elements) is relatively high. The off-center location of the tilting axis results in a distribution of the closing movements of the hair-clamping elements. This distribution leads to an increased angular bandwidth about the axis of rotation, wherein the rotating epilating system is able to catch hairs at the skin-contacting area. This distribution further reduces the sudden change of the overall shape of the epilating system when the hair-clamping elements pivot relative to each other.

Preferred embodiments of the invention are defined in the dependent claims.

It will be understood that the invention may not only be used in the given combination or the claims, but also in different combinations or independently, without leaving the scope of the present invention.

According to one embodiment of the invention the tilting axis of each pair of hair-clamping elements is defined by at least one protrusion arranged on at least one of the hair-clamping elements of the pair, said protrusion preferably configured as an elongated ridge.

In this way the tilting axis is designed in a very simple and reliable way.

According to another embodiment of the invention each hair-clamping element comprises a receiving opening arranged centrally on the hair-clamping element for receiving a supporting shaft extending through the clamping elements, and in that the tilting axis of each pair of hair-clamping elements is defined by two elongated ridges arranged aligned with each other on opposite sides of the receiving opening at a distance therefrom.

This provides for a very stable situation and poses little risk that two adjacent disks interact in a centrally located part of the elongated ridge in the vicinity of the receiving opening due to tolerances. So the tilting axis between a pair of adjacent hair-clamping elements defined by the elongated ridge is more precisely defined.

According to another embodiment of the invention the tilting axis is arranged eccentrically relative to the axis of rotation by a distance of 0.1 to 2 mm, preferably 0.3 to 1.5 mm, more preferably 0.5 to 1.0 mm, and most preferably 0.6 to 0.8 mm.

It was found that using such an eccentricity a very favorable hair-catching efficiency can be reached.

According to another embodiment of the invention each two adjacent pairs of hair-clamping elements are oriented relative to each other about the axis of rotation at an angle of 90°.

This feature further helps to improve the hair-catching efficiency.

According to another embodiment of the invention the hair-clamping elements are each configured in disk-shape and at least some of the hair-clamping elements each comprise four hair-clamping areas, wherein a first and a second of said four hair-clamping areas are arranged on one side of the hair-clamping element in diametrically opposite positions with respect to the axis of rotation, and wherein a third and a fourth of said four hair-clamping areas are arranged on the other side of the hair-clamping element in diametrically opposite positions oriented at an angle of 90° relative to the first and second hair-clamping areas about the axis of rotation.

This further helps to improve the distribution of the closing movements of the hair-clamping elements and further helps to improve the angular bandwidth about the axis of rotation, wherein the rotating epilating system is able to catch hairs at the skin-contacting area.

According to a further embodiment of the invention during rotation of the epilating system in a direction of rotation about the axis of rotation the hair-clamping elements of a first set of pairs of hair-clamping elements tilt from the hair-catching position into the hair-clamping position at a first angle of rotation of the epilating system defined relative to a base plane wherein the axis of rotation extends, and wherein the hair-clamping elements of a second set of hairs of hair-clamping elements tilt from the hair-catching position into the hair-clamping position at a second angle of rotation of the epilating system defined relative to the base plane.

According to another embodiment of the invention the first angle of rotation of the epilating system measured from the base plane in the direction of rotation is preferably 250° to 280°, preferably 260° to 270°, most preferably 263° to 265°.

According to another embodiment of the invention the second angle of rotation of the epilating system measured from the base plane the direction of rotation is preferably 285° to 315°, preferably 295° to 310°, most preferably 301° to 303°.

So according to the invention preferably there are two hair-clamping positions arranged at different angles of rotation that lead to a very good hair-catching efficiency.

According to another embodiment of the invention the pairs of adjacent hair-clamping elements each comprise torque-transmitting elements engaging each other for transmitting torque between the adjacent hair-clamping elements.

This feature allows for an easy torque transmitting, even if only one end of the plurality of hair-clamping elements is driven rotatingly by the drive system.

According to a further embodiment of the invention the pairs of adjacent hair-clamping elements each comprise protrusions provided on one of the hair-clamping elements of the pair engaging with recesses provided on the other one of the hair-clamping elements of the pair.

This allows for an easy torque transmission.

According to another embodiment of the invention the hair-clamping elements are rotatably supported by a curved supporting shaft mounted in a stationary position relative to the housing, wherein the hair-clamping elements each comprise a receiving opening arranged centrally on the hair-clamping element for receiving the supporting shaft.

Such a design leads to a very effective epilating system.

According to another embodiment of the invention each hair-clamping element comprises two torque-transmitting elements on each side, each torque-transmitting elements being arranged on opposite sides of the receiving opening, wherein two torque-transmitting elements define an imaginary line linking the centers of the torque-transmitting elements, and wherein the tilting axis of each pair of hair-clamping elements extends in parallel to the imaginary line.

Such a design allows for an easy tilting movement of each pair of hair-clamping elements with respect to each other between the hair-catching and the hair-clamping positions, independently from the torque-transmitting elements.

BRIEF DESCRIPTION OF THE DRAWINGS

These and other aspects of the invention will become apparent from and elucidated with reference to the embodiment described hereinafter. In the following drawings

DETAILED DESCRIPTION OF THE EMBODIMENTS

Figure 1:
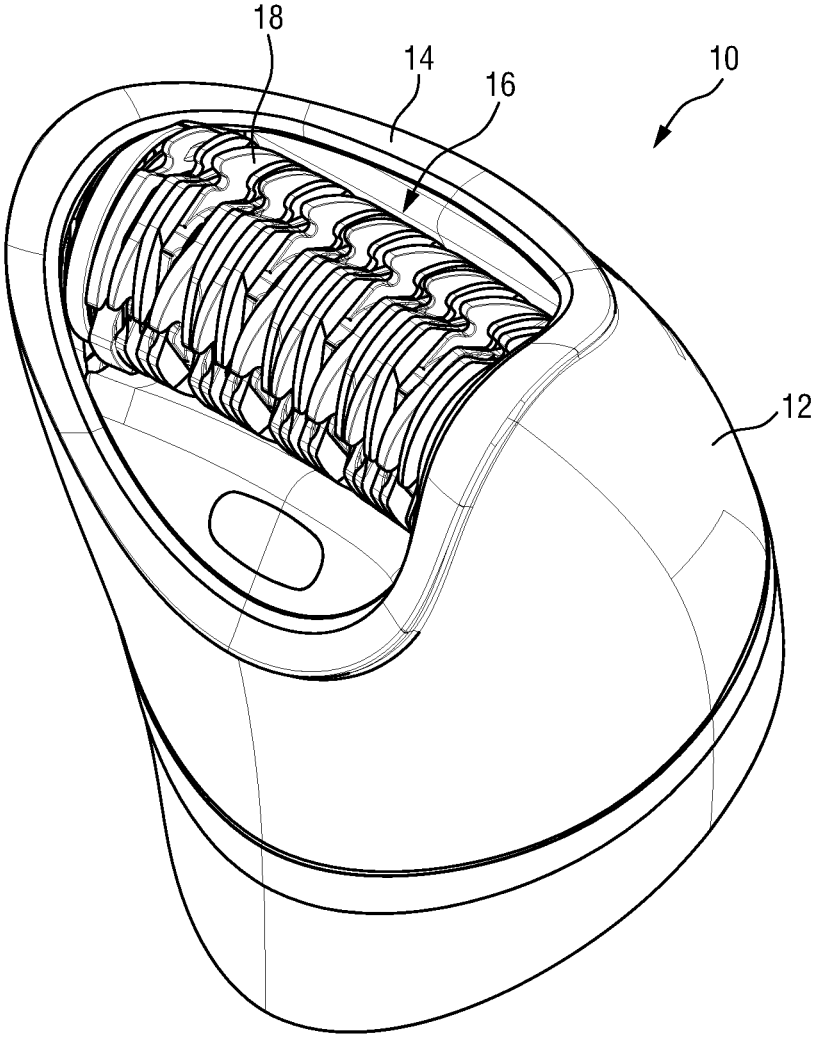
FIG. 1 shows an enlarged partial perspective representation of an epilating device according to the invention.

In FIG. 1 an epilating device according to the invention is shown in an enlarged partial perspective representation and designated in total with reference numeral 10.

The epilating device 10 comprises a housing 12 having at its top end an epilating opening 14 through which an epilating system 16 is accessible from the outside. The epilating system 16 comprises a series of hair-clamping elements 18 that are arranged in stacked relationship in pairs adjacent to each other and rotatable to the housing 12 about an axis of rotation.

Figure 2:
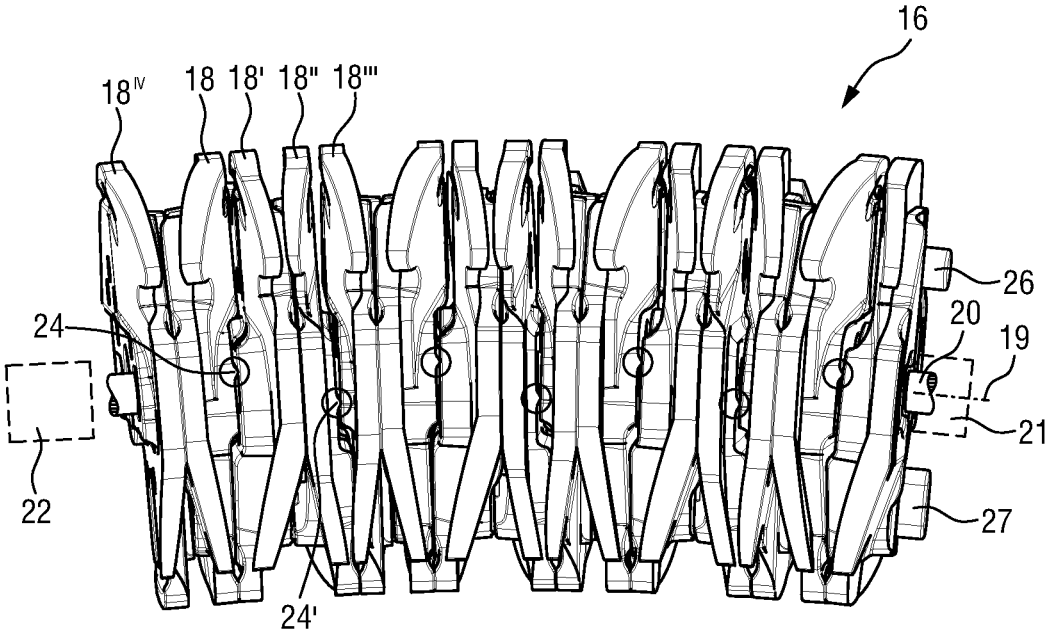
FIG. 2 shows an enlarged representation of a stack of a hair-clamping elements arranged adjacent to each other on a curved supporting shaft compressed by a compression member and driven by a drive system.

The epilating system 16 is shown in FIG. 2 in a side view, wherein a stack of adjacent hair-clamping elements is shown supported on a curved supporting shaft 20. The hair-clamping elements are arranged in pairs cooperating with each other. Only the hair-clamping elements 18, 18' of a first pair and the hair-clamping elements 18", 18'" of an adjacent second pair are designated. Via a disk-shaped end plate $\mathbf{18}^{IV}$ the first hair-clamping element 18 is driven by a drive system that is only indicated by a dashed box 22.

The curved support shaft 20 extends along a curved axis of rotation 19. The complete stack of hair-clamping elements 18, 18', 18", 18'" including the end-disk $\mathbf{18}^{IV}$ is biased by a compression member against the drive system 22. The compression member is merely indicated by a dashed box 21 shown on the right end.

When the drive system 22 is activated, then the hair-clamping elements 18, 18', 18", 18'" and the end disk $\mathbf{18}^{IV}$ are rotated about the curved shaft 20. For transmitting the torque between the individual elements $\mathbf{18}^{IV}$, 18, 18', 18", 18'" etc., the pairs of adjacent hair-clamping elements 18, 18', 18", 18'", and the end disk $\mathbf{18}^{IV}$ each comprise torque-transmitting elements engaging each other for transmitting torque therebetween. In FIG. 2 only two torque transmitting elements 26, 27 shown on the right end can be seen. The respective torque transmitting elements, one of which 26 is configured as a cylindrical protrusion, and the other one 27 being configured as an elongated ridge (see FIG. 3) engage with associated recesses provided on the adjacent element.

Also the end disk $\mathbf{18}^{IV}$ is provided with respective protrusions 26, 27 on the one side and associated recesses on the other side wherein the drive system 22 engages.

Figure 3:
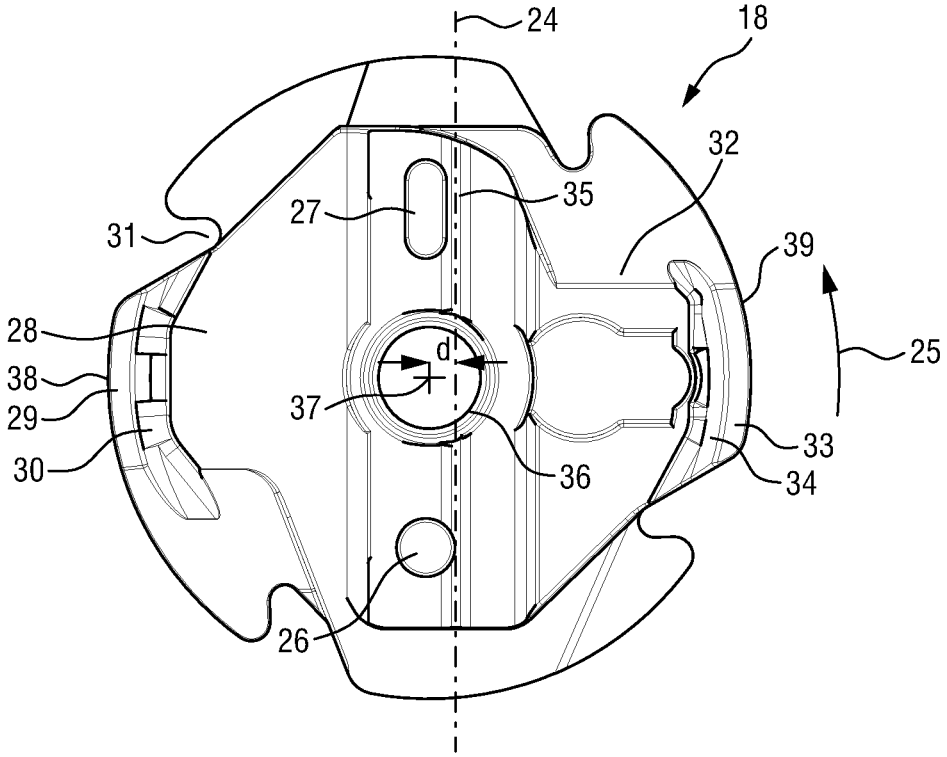
FIG. 3 shows an enlarged representation of one of the hair-clamping elements, seen from a top side.

FIG. 3 shows a top view of one of the hair-clamping elements 18 according to the invention.

The hair-clamping element 18 is basically disk-shaped with a central receiving opening 36 through which the curved shaft 20 extends.

The clamping element 18 comprises four lands extending from the receiving opening 36 outwardly that are of substantially identical shape, wherein each of which is displaced with respect to the adjacent one by 90° about the center 37 of the receiving opening 36. In FIG. 3 only two lands arranged on opposite sides of the receiving opening 36 are designated with reference numerals 28, 32.

Between adjacent lands there are provided cutouts 31 extending from the outer, peripheral surface towards the center 37 against the direction of rotation 25. On each land 28, 32 there is defined a hair-clamping area 29, 33 extending from a peripheral surface towards the center 37 and being delimited by a respective curved protrusion 30, 34. Thus the hair-clamping element 18 on the front side thereof comprises two hair-clamping areas 29, 33 that are arranged on opposite sides of the receiving opening 36 and that are relatively slim areas extending from the circumferential edges 38, 39 toward a curved protrusion 30, 34.

On the back side of the clamping element 18 on the two remaining lands opposite to the receiving opening 36 and rotated by 90° with respect to the lands 28, 32 corresponding hair-clamping areas are formed that are identical to the hair-clamping areas 29, 33 on the front side.

Each hair-clamping element 18, 18', 18", 18'" on a first side thereof comprises two torque-transmitting elements 26, 27 which are configured as protrusions and are arranged opposite to each other with respect to the receiving opening 36. One of these torque-transmitting elements is configured as a cylindrical protrusion 26, while the other one is configured as a longitudinal protrusion 27.

If an imaginary line is drawn through the two torque-transmitting elements 26, 27 it runs through the center 37 of the receiving opening 36. Parallel to this imaginary line a tilting axis 24 arranged offset from the center 37 by an amount d extends. This tilting axis 24 is defined by an elongated ridge 35 extending in parallel to the imaginary line and being interrupted by the receiving opening 36. Together with a surface of an adjacent hair-clamping element 18' the tilting axis 24 is defined.

In FIG. 2 the respective tilting axes between adjacent pairs of hair-clamping elements 18, 18', 18'', 18''' are indicated with a circle and designated by reference numerals 24, 24'.

Since two adjacent pairs 18, 18'; 18'', 18''' of hair-clamping elements are oriented relative to each other about the axis of rotation 19 at an angle of 90°, the tilting axis 24, 24' defined in this way are diffused over two vertical positions, one of which is higher, extending substantially close to the axis of rotation 19, while the other one indicated by 24' is lower.

Dynamically, when the drive system 22 is operated, this means that half of the hair-clamping elements will close earlier and half will close later. The ones that close later are forced in a fully opened state for a longer time and snap to a closed state in a shorter time. It was found that this effect increases the probability that a hair will be caught by the hair-clamping elements (what is defined as hair-catching efficiency).

Figure 4:
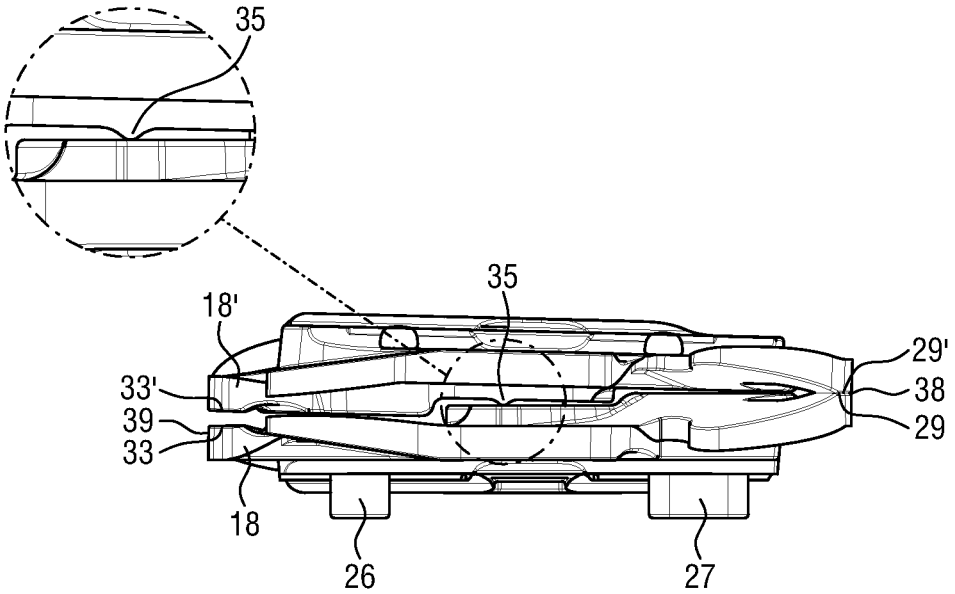
FIG. 4 shows one pair of hair-clamping elements cooperating with each other shown in a first hair-clamping position, wherein a first pair of hair-clamping areas on the right side are shown in a hair-clamping position.
Figure 5:
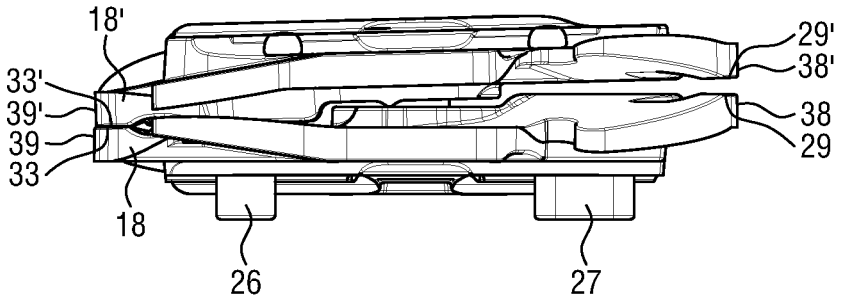
FIG. 5 shows the pair of hair-clamping elements according to FIG. 4 in a second position, wherein a second pair of hair-clamping areas on the left side is in the hair-clamping position.

In FIGS. 4 and 5 the interaction of a pair of adjacent hair-clamping elements 18, 18' is shown.

The adjacent hair-clamping elements 18, 18' are pressed against each other by the compression member 21. The hair-clamping elements 18, 18' are held on the curved shaft 20 that protrudes through the receiving opening 36 and are driven with respect to each other by the torque-transmitting elements 26, 27, wherein the protrusions of one hair-clamping element 18' engage with respective recesses of the other hair-clamping element 18. The single tilting axis defined by the elongated ridge 35 is shown enlarged within the encircled area of FIG. 4. In FIG. 4 a first hair-clamping position is shown, wherein the adjacent first hair-clamping areas 29, 29' on the right side are in the hair-clamping position clamped against each other, while the adjacent second hair-clamping areas 33, 33' on the left side are in the open position at a distance from each other. In FIG. 5 a second hair-clamping position is shown, wherein the adjacent second hair-clamping areas 33, 33' on the left side of the hair-clamping elements 18, 18' are in the hair-clamping position clamped against each other, while the adjacent first hair-clamping areas 29, 29' on the right side are in the open position at a distance from each other. As shown in FIG. 4, the first and second hair-clamping areas 29, 29', 33, 33' each extend in a radial direction relative to the axis of rotation 19 until the circumferential edge 38, 38', 39, 39' of the respective hair-clamping element 18, 18'. In the hair-clamping positions the hair-clamping areas 29, 29', 33, 33' are in mutual clamping engagement at least at the circumferential edges 38, 38', 39, 39' of the hair-clamping elements 18, 18', so that hairs as short as possible can be clamped between the hair-clamping areas 29, 29', 33, 33'.

Figure 6:
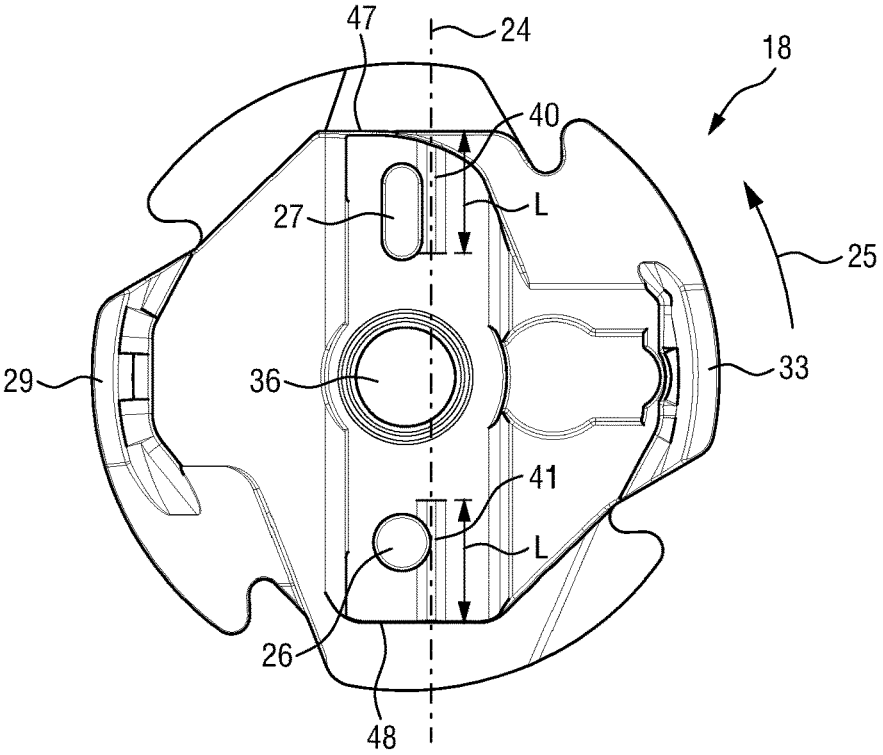
FIG. 6 shows another embodiment of a hair-clamping element of a slightly different design than shown in FIG. 3, wherein the tilting axis is defined by two elongated ridges arranged aligned with each other on opposite sides of the receiving opening arranged at a distance therefrom.

In FIG. 6 a slightly different design of a hair-clamping element 18 is shown. In this representation for corresponding parts corresponding reference numerals are used.

The only difference to the hair-clamping element 18 shown in FIG. 3 is that the elongated ridge 35 defining the tilting axis 24 is shortened on both sides of the receiving opening 36. The elongated ridge does not extend to the center close to the receiving opening 36. So in this case there are two elongated ridges 40, 41 extending over a certain length L from a certain distance from the circumferential edge defining a line 47 on the one side and defining a line 48 on the opposite side. So the central region adjacent to the receiving opening 36 is free from any protrusion or elongated ridge.

This design helps to ensure that by the two elongated ridges 38, 39 that are arranged aligned with each other provide a more stable situation than with the embodiment according to FIG. 3 and poses less risk that two hair-clamping elements interact in the centrally located part due to any tolerances. So the interface or tilt axis 24 between a pair of adjacent hair-clamping elements 18, 18' is more clearly defined.

Figure 7:
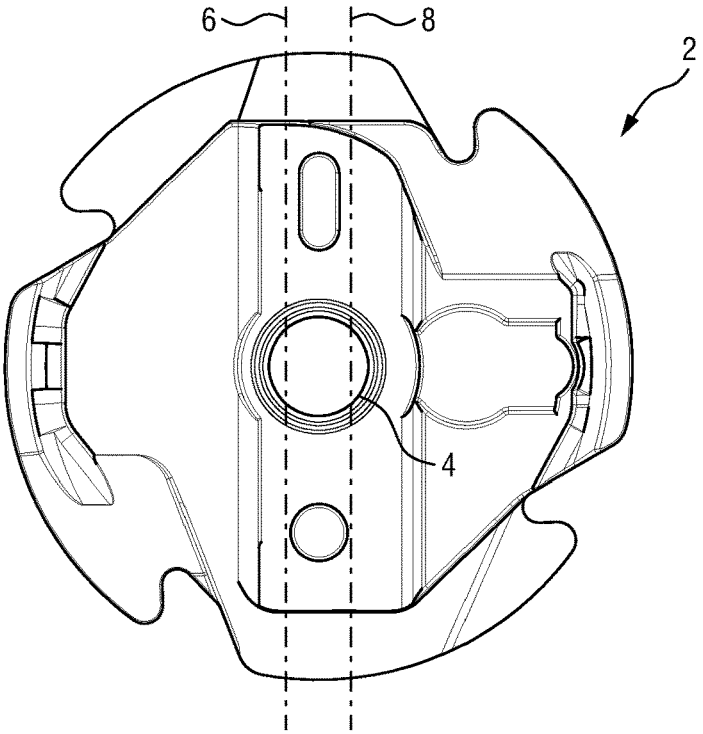
FIG. 7 shows a prior art design of a hair-catching element with two parallel tilting axes arranged off-center from a central receiving opening on opposite sides thereof.

In FIG. 7 the prior art configuration according to the epilator that has been used in public is shown.

In this case a hair-clamping element 2 of generally identical shape to the one described with respect to FIG. 3 is shown. The difference rests in the fact that according to the prior art hair-clamping element 2 there are two tilting axes 6, 8 that are arranged off-center from the receiving opening 4.

So according to the prior art there is always one neutral position, wherein two adjacent hair-clamping elements 2 are parallel to each other, further one first tilting position, wherein the hair-clamping elements 2 are tilted about the first tilting axis, and another tilting position, wherein the two adjacent hair-clamping elements are tilted about the second tilting axis 8.

When compared to the invention, according to the invention there is no neutral position. The two hair-clamping elements 18, 18' are tilted either to the right side as shown in FIG. 4 or to the left side as shown in FIG. 5.

This means that according to the invention the hair-clamping elements are tilted only about a single tilting axis when moving from the first to the second clamping position. According to the prior art there is a first clamping position, wherein the hair-clamping elements are tilted about the first tilting axis, and there is a second clamping position, wherein the hair-clamping elements are tilted about the second tilting axis.

According to the invention the closing distance of a single pair of hair-clamping elements—the displacement for a set of hair-clamping elements that is required to move from a fully opened state to a fully closed state is decreased when compared with the prior art, wherein there are two tilting axes and a neutral position.

Figure 8:
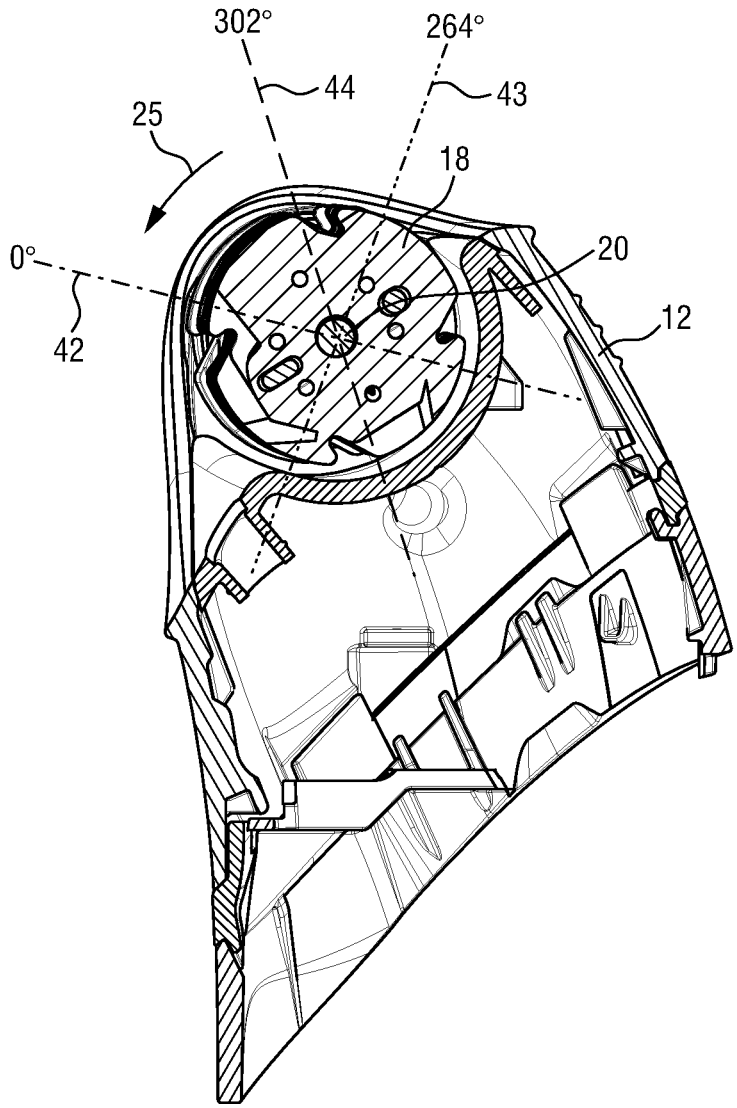
FIG. 8 shows an enlarged partial cross-sectional view of the epilating device according to FIG. 1 wherein the different angles of the hair-catching positions of the epilating system are shown.

In FIG. 8 the hair-clamping positions are shown. The base plane, wherein the axis of rotation 19 and the curved support shaft 20 extend, is indicated by 42. During rotation of the epilating system in the direction of rotation 25 after an angle of 264° indicated by 43 the hair-clamping elements of a first set of pairs of hair-clamping elements reach a hair-clamping position, while after an angle of 302° indicated by 44 a second set of pairs of hair-clamping elements reach a hair-clamping position.

According to the prior art there is only the second hair-clamping position indicated by 44.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. An epilating device for extracting hairs out of a user's skin, comprising:

a housing;

an epilating system comprising a plurality of hair-clamping elements arranged adjacent to each other and rotatable relative to the housing about an axis of rotation;

a compression member arranged to exert a compression force on the epilating system along at least a compression line which extends parallel to a main direction of extension of the axis of rotation; and a drive system arranged to rotate the hair-clamping elements about a supporting shaft extending along the axis of rotation, wherein each hair-clamping element comprises a receiving opening arranged centrally on the hair-clamping element for receiving the supporting shaft, wherein the hair-clamping elements are arranged to cooperate in pairs, and wherein, during rotation of the epilating system, the hair-clamping elements of each pair of hair-clamping elements are tiltable relative to each other, under influence of said compression force, about only one tilting axis from a first hair-clamping position, wherein two adjacent first hair-clamping areas of the each pair of hair-clamping elements are in mutual clamping engagement, into a second hair-clamping position, wherein two adjacent second hair-clamping areas of the each pair of hair-clamping elements are in mutual clamping engagement, wherein the only one tilting axis is arranged eccentrically relative to the axis of rotation in the supporting shaft, and wherein the second hair-clamping areas are arranged opposite to the first hair-clamping areas relative to the axis of rotation.

2. The epilating device of claim 1, wherein the tilting axis of the each pair of hair-clamping elements is defined by at least one protrusion arranged on at least one of the hair-clamping elements of the pair.

3. The epilating device of claim 2, wherein the at least one protrusion arranged on the at least one of the hair-clamping elements of the pair is configured as an elongated ridge.

4. The epilating device of claim 1, wherein the tilting axis of the each pair of hair-clamping elements is defined by two elongated ridges arranged aligned with each other on opposite sides of said receiving opening at a distance therefrom.

5. The epilating device of claim 1, wherein the tilting axis is arranged eccentrically relative to the axis of rotation by a distance of 0.1 to 2 millimeters.

6. The epilating device of claim 1, wherein each two adjacent pairs of hair-clamping elements are oriented relative to each other about the axis of rotation at an angle of 90°.

7. The epilating device of claim 6, wherein the hair-clamping elements are each configured in a disk-shape and at least some of the hair-clamping elements each comprise four hair-clamping areas, wherein a first and a second of said four hair-clamping areas are arranged on one side of the hair-clamping element in diametrically opposite positions with respect to the axis of rotation, and wherein a third and a fourth of said four hair-clamping areas are arranged on the other side of the hair-clamping element in diametrically opposite positions oriented at an angle of 90° relative to the first and second hair-clamping areas about the axis of rotation.

8. The epilating device of claim 1, wherein, during rotation of the epilating system in a direction of rotation about the axis of rotation, the hair-clamping elements of a first set of pairs of hair-clamping elements tilt from a hair-catching position into the first hair-clamping position at a first angle of rotation of the epilating system defined relative to a base plane where the axis of rotation extends, and wherein the hair-clamping elements of a second set of pairs of hair-clamping elements tilt from the hair-catching position into the second hair-clamping position at a second angle of rotation of the epilating system defined relative to the base plane.

9. The epilating device of claim 8, wherein the first angle of rotation of the epilating system measured from the base plane in the direction of rotation is 250° to 280°.

10. The epilating device of claim 8, wherein the second angle of rotation of the epilating system measured from the base plane in the direction of rotation is 285° to 315°.

11. The epilating device of claim 1, wherein the pairs of adjacent hair-clamping elements each comprise torque-transmitting elements engaging each other for transmitting torque between the adjacent hair-clamping elements.

12. The epilating device of claim 11, wherein the pairs of adjacent hair-clamping elements each comprise protrusions provided on one of the hair-clamping elements of the pair engaging with recesses provided on the other one of the hair-clamping elements of the pair.

13. The epilating device of claim 1, wherein the supporting shaft is curved in a longitudinal direction and mounted in a stationary position relative to the housing.

14. The epilating device of claim 13, wherein each hair-clamping element comprises two torque-transmitting elements, wherein each torque-transmitting element is arranged on opposite sides of said receiving opening, said two torque-transmitting elements defining an imaginary line linking the centers of said two torque-transmitting elements, and wherein said tilting axis of each pair of hair-clamping elements extends in parallel to said imaginary line.

15. The epilating device of claim 14, wherein the two torque-transmitting elements comprise a cylindrical protrusion and an elongated ridge.

16. An epilating device for extracting hairs out of a user's skin, the epilating device comprising:

a housing;

an epilating system comprising a plurality of hair-clamping elements arranged adjacent to each other and rotatable relative to the housing about an axis of rotation, each hair-clamping element of the plurality of hair-clamping elements defining a receiving opening arranged centrally and configured to receive a supporting shaft that includes the axis of rotation;

a compression member arranged to exert a compression force on the epilating system in a direction parallel to a main direction of extension of the axis of rotation; and a drive system arranged to rotate the hair-clamping elements about the supporting shaft, wherein the hair-clamping elements are arranged to cooperate in pairs, and wherein, during rotation of the epilating system, the hair-clamping elements of each pair of hair-clamping elements are tiltable relative to each other, under influence of said compression force, about a single tilting axis that extends perpendicular to the axis of rotation and is offset from a center of the receiving opening receiving the supporting shaft relative to the axis of rotation.

17. The epilating device of claim 16, wherein the hair-clamping elements of each pair of hair-clamping elements are tiltable about the single tilting axis from a first hair-clamping position, wherein two adjacent first hair-clamping areas of the each pair of hair-clamping elements are in mutual clamping engagement, into a second hair-clamping position, wherein two adjacent second hair-clamping areas of the each pair of hair-clamping elements are in mutual clamping engagement, and wherein the second hair-clamping areas are arranged opposite to the first hair-clamping areas relative to the axis of rotation.

18. The epilating device of claim 16, wherein the tilting axis of the each pair of hair-clamping elements is defined by at least one elongated ridge on at least one of the hair-clamping elements of the pair.

19. The epilating device of claim 16, wherein the tilting axis is offset from the center of the receiving opening receiving the supporting shaft relative to the axis of rotation by a distance of 0.1 to 2 millimeters.

20. The epilating device of claim 16, wherein each two adjacent pairs of hair-clamping elements are oriented relative to each other about the axis of rotation at an angle of 90°.

* * * * *